US006782228B1

(12) United States Patent
Rasch et al.

(10) Patent No.: US 6,782,228 B1
(45) Date of Patent: Aug. 24, 2004

(54) INTERMITTENT STRIPPER FINGERS AND BAFFLE FOR STRIPPING COPY MEDIA FROM A HEATED FUSER ROLL

(75) Inventors: Kenneth R. Rasch, Fairport, NY (US); Paul M. Fromm, Rochester, NY (US); Stephen D. Cipolla, Fairport, NY (US); Erwin Ruiz, Rochester, NY (US); Gregory P. Miller, Rochester, NY (US); David R. Kamprath, Webster, NY (US); Richard C. Benton, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/355,565

(22) Filed: Jan. 30, 2003

(51) Int. Cl.[7] ..... G03G 15/20
(52) U.S. Cl. ..... 399/323
(58) Field of Search ..... 399/323, 398, 399/22, 322; 271/308, 311, 312, 313

(56) References Cited

U.S. PATENT DOCUMENTS 3,578,859 A 5/1971 Stillings
3,844,252 A 10/1974 Thettu
4,028,050 A 6/1977 Bar-on
4,065,120 A 12/1977 Imaizumi et al.
4,119,307 A 10/1978 Hamaker
4,408,757 A * 10/1983 Yarm ..... 399/323
5,406,363 A 4/1995 Siegel et al.
5,623,720 A 4/1997 Howe et al.

FOREIGN PATENT DOCUMENTS

JP 05307336 A * 11/1993 ..... G03G/15/20

* cited by examiner

*Primary Examiner*—Arthur T. Grimley
*Assistant Examiner*—Ryan Gleitz

(57) ABSTRACT

Media removal apparatus having a stripper finger structure for separating the lead edge of an imaging media such as plain paper from a heated fuser roll and a stripper baffle for separating the portion of the imaging media beyond the lead edge of the imaging media from the heated fuser roll. The stripper finger structure is supported for movement between a home or standby position and an active position, with the finger tips in constant contact with the heated fuser roll, for effecting separation of the media's lead edge from the heated fuser roll. Likewise, the stripper baffle structure is supported for movement between home or standby positions to its active position where it effects separation of a portion of the imaging media beyond its lead edge.

20 Claims, 15 Drawing Sheets

INTERMITTENT STRIPPER FINGERS AND BAFFLE FOR STRIPPING COPY MEDIA FROM A HEATED FUSER ROLL

BACKGROUND OF THE INVENTION

This invention relates generally to a heat and pressure fusing apparatus and, more particularly, to imaging media removal apparatus for separating imaging media such as plain paper from a heated fuser roll.

In a typical electrophotographic copying or printing process, a charge retentive surface such as a photoconductive member is charged to a substantially uniform potential so as to sensitize the surface thereof. The charged portion of the photoconductive member is selectively exposed to light to dissipate the charges thereon in areas subjected to the light. This records an electrostatic latent image on the photoconductive member. After the electrostatic latent image is recorded on the photoconductive member, the electrostatic latent image is rendered visible by bringing one or more developer materials into contact therewith. Generally, the developer material comprises toner particles adhering triboelectrically to carrier granules. The toner particles are attracted from the carrier granules either to a donor roll or to a latent electrostatic image on the photoconductive member. When attracted to a donor roll the toner particles are subsequently deposited on the latent electrostatic images. The toner powder image is then transferred from the photoconductive member to a final substrate or imaging media. The toner particles forming the toner powder images are then subjected to a combination of heat and/or pressure to permanently affix the powder images to the copy substrate.

In order to fix permanently or fuse the toner material onto a substrate or support member such as plain paper by heat, it is necessary to elevate the temperature of the toner material to a point at which constituents of the toner material coalesce and become tacky. This action causes the toner to flow to some extent onto the fibers and/or into the pores of the support member or otherwise upon the surface thereof. Thereafter, as the toner material cools, solidification of the toner material occurs causing the toner material to be bonded firmly to the support member.

One approach to thermal fusing of toner material images onto the final substrate or imaging media has been to pass the substrate with the unfused toner images thereon between a pair of opposed roller members, at least one of which is internally heated. During operation of a fusing system of this type, the substrate to which the toner images are electrostatically adhered is moved through a nip formed between the pressure engaged rolls with the toner images contacting the heated fuser roll to thereby effect heating of the toner images within the nip.

A plurality of stripper fingers is usually provided for effecting separation of the final substrate or imaging media from the heated fuser roll. The fingers physically contact the surface of the heated fuser roll such that the tips thereof are inserted between the lead edge of the imaging media and the heated fuser roll. Stationary baffles have been employed for receiving the imaging media once it has been separated from a heated fuser roll. Such baffles are supported in a fixed position downstream of the fuser nip for transporting or guiding imaged substrates toward the exit of a reproduction machine.

Contact stripper fingers typically leave disruptions in the toner on an imaging media or substrate such as plain paper, often severe enough to be objectionable to the customer. To obviate the foregoing problem, Nip Forming Fuser Rolls (NFFR) and/or air stripper systems have been utilized for separating or stripping of imaging media from the heated fuser roll. The air stripper approach works well in eliminating finger marks but the cost of an air stripping system is quite high and consumes 300–500 additional watts for the compressor and is a fairly complex arrangement. Thus, in order to avoid the higher cost and complexity of air stripper devices, improvements in contact stripping of substrates are most desirable.

Accordingly, the present invention is directed to an improved image media removal apparatus for separating imaging media such as plain paper from a heated fuser roll. To this end, there is provided a stripper finger structure movable between standby and active positions for separating the lead edge of the imaging media when in its active position and a stripper baffle structure movable between standby and active positions for separating the imaging media beyond the lead edge thereof.

Following is a discussion of references, the disclosures each of which are lo hereby incorporated by reference in their entirety.

U.S. Pat. No. 3,578,859 granted to William K. Stillings on May 18, 1971 discloses apparatus to remove an insulating copy sheet from a moving photoconductive surface, the copy sheet being electrostatically tacked to the surface prior to removal by a corona discharge device during a xerographic image transfer operation. A stripping finger is arranged to lift the leading edge of a sheet being advanced on the photoconductive surface and to direct the sheet upwardly away from the surface. A stationary transport having a smooth flat platen to receive a stripped copy sheet in sliding relation therewith is positioned to intercept the leading edge of the stripped sheet and direct the sheet towards a subsequent processing station. Suction ports in the platen located behind the point of contact of the leading edge of the sheet lift the body of the sheet from the stripper finger and hold the sheet in sliding contact with the platen. Lifting means raise the stripper finger away from the moving surface and further stripping of the sheet is accomplished as the sheet slides along the platen and is lifted from the drum surface.

U.S. Pat. No. 3,844,252 discloses a sheet removal device for separating an image bearing support sheet from the surface of a heated fuser roll. The removal device is constructed in a configuration and of a material to prevent copy degradation and harming of the fuser roll during the sheet separating operation.

U.S. Pat. No. 4,065,120 granted to Fromm et al on Oct. 13, 1998 discloses a slidably and pivotally mounted means for stripping copy paper from one or both rolls of a fuser assembly in a photocopying machine. Spring means urging the stripping means into contact with a roll is normally countered by a component of frictional force exerted by the roll on the stripping means, thereby avoiding exertion of undue pressure on the roll. If copy paper becomes adhered to and cannot be detached in a normal manner from the roll, the stripping means is moved to a position in which the tip portion thereof no longer contacts the roll, thereby avoiding damage to the roll and stripping means.

U.S. Pat. No. 4,028,050 granted to Ari Bar on Jun. 7, 1977 discloses apparatus where stripping copy sheets from a heated fuser member utilized in a xerographic copier. The apparatus is characterized by the provision of a plurality of stripper fingers and combination support and bias means therefor wherein the support and bias means comprises a unitary member and each stripper finger in conjunction with its associated unitary member constitutes an integral assembly. The assemblies are fixedly supported adjacent the fuser member whereby the leading edges of the stripper fingers engage the fuser member to strip the copy sheets therefrom. The position of the assemblies can be varied in order to vary the pressure exerted by the stripper finger on the fuser assembly.

U.S. Pat. No. 4,119,307 granted to Ralph A. Hamaker on Oct. 10, 1978 discloses an apparatus in which a stripping member separates a sheet adhering to a moving member. The stripping member is translatable so as to maintain the spacing between the moving member and the surface of the stripping member opposed therefrom substantially constant.

U.S. Pat. No. 5,406,363 granted to Siegel et al on Apr. 11, 1995 discloses an apparatus for minimizing fuser misstrips from a heat and pressure fuser in an electrophotographic printing machine. A plurality of sensors are provided to determine the basis weight of the copy sheet, the density of the image being transferred to the copy sheet and fused thereon, the relative humidity of the machine environment, the process speed of the print engine, etc. Signals indicative of all the variables are generated and sent to the machine controller, which processes these signals and predicts when a fuser misstrip is likely to occur. Based on the likely degree of misstrip, a variety of actions are taken to prevent the misstrip. A stripper finger can be actuated to physically remove the sheet from the fuser member and/or the release agent management system can vary the amount of release agent applied to the fuser to assist in the removal of the copy sheet from the heated fuser member. The overall system provides the advantage of a varying amount of fuser release agent so that an extreme buildup of oil is not encountered, and further allows an intermittent stripper finger use to prevent premature wear of the fuser member by the constant pressure of a stripper finger.

U.S. Pat. No. 5,623,720 granted to Howe et al on Apr. 22, 1997 discloses a novel method and apparatus for rotating a stripper bar associated with a paper path. A cam and cable mechanism replaces a rigid link mechanism on the stripper bar, the cam and cable mechanism providing for a much greater angle of rotation of the stripper bar than the rigid link mechanism. The additional rotation allows the stripper fingers on the stripper bar to be rotated completely out of the way of a paper jam clearance path. Other new developments include a wrench positioning system that controls the orientation of the stripper bar and an over- rotation prevention system that stops the rotation of the stripper bar when the stripper bar and stripper fingers are being serviced.

BRIEF SUMMARY OF THE INVENTION

The present invention provides an imaging media removal apparatus including a stripper finger structure for separating the lead edge of the imaging media and a stripper baffle structure for effecting separation of the imaging media beyond the lead edge. The stripper fingers are active for the first 3–15 mm of the imaging media after which imaging media stripping is under the control of the stripper baffle structure which is moved into close proximity to the nip exit of the fuser for that purpose.

The stripper fingers operate intermittently, that is, they are activated from a standby position as a group, prior to the imaging media arriving at the fuser nip exit, during the inter copy gap, and remain functional until the media is under the control of a stripping baffle, approximately 2–75 mm, preferably 3–15 mm after the lead edge of the imaging media has moved past the stripper finger tips. Unlike prior art baffles; the exit baffle of the present invention is moved to a position in close proximity to the fuser roll within 0.5–1 mm away. The prime benefit of the invention is that stripper finger marks are limited to the first few millimeters of the media when there is development material in that area and a secondary advantage is that the finger tip wear would be reduced because of the reduced time the fingers are actively stripping. The movement of the baffle into close proximity of the strippers allows the stripper fingers to function for a shorter time interval as compared to prior art devices. In other words, the fingers remain in contact with the imaging media for only a short interval of time.

DETAILED DESCRIPTION OF THE PREFERRED EMBODIMENT(S) OF THE INVENTION

There is provided a heat and pressure fuser apparatus including pressure engageable rolls forming a nip through which imaging media such as plain paper pass with toner images carried thereby contacting a heated roll forming a part of the fuser apparatus. The primary purpose of the present invention is to provide apparatus for separating of imaging media from the heated fuser roll.

Figure 1:
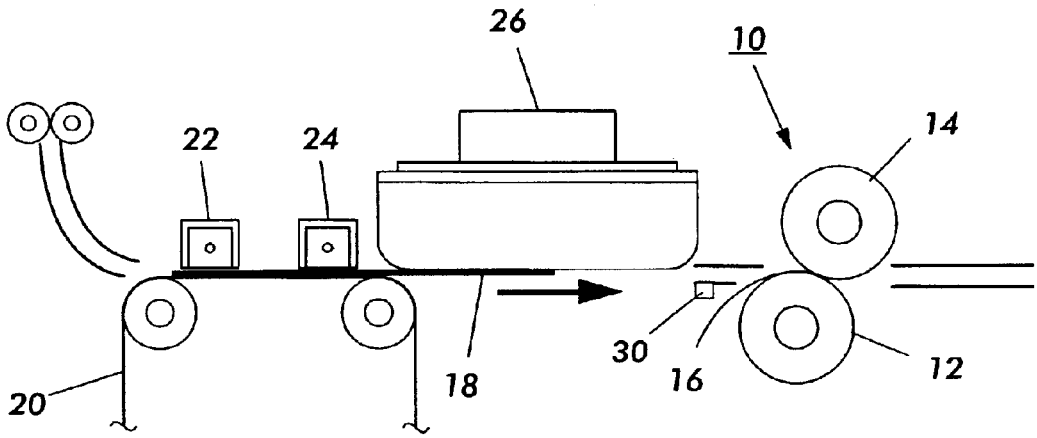
FIG. 1 is a schematic view of charge retentive member and a vacuum transport for conveying an imaging media from a charge retentive member to the nip of a heat and pressure fuser apparatus.

Depicted schematically, in FIG. 1, is a heat and pressure fuser indicated generally by the reference character 10. The fuser 10 comprises a heated fuser roll 12 and a pressure roll 14 forming a nip 16 through which imaging media 18 carrying toner images pass with the toner images contacting the heated fuser roll 12. Toner images are transferred from a charge retentive member 20 to the imaging media 18. Such transfer is assisted using a transfer discharge device 22. A detack discharge device 24 facilitates separation of the imaging media from the charge retentive member 20.

A vacuum transport 26 moves the imaging media, once it is separated from the charge retentive member, into the nip 16 formed between the pressure engaged fuser and pressure rolls.

An imaging media sensor 30 is positioned adjacent the vacuum transport 26 for sensing the position of imaging media. Firmware, not shown, processes signals generated by the media position sensor 30 for controlling operation of a finger stripper structure 32 (FIGS. 2, 3, 13, and 14) and a stripping baffle structure 34 (FIGS. 2, 3 and 15) forming a part of a media removal apparatus 35.

Figure 13:
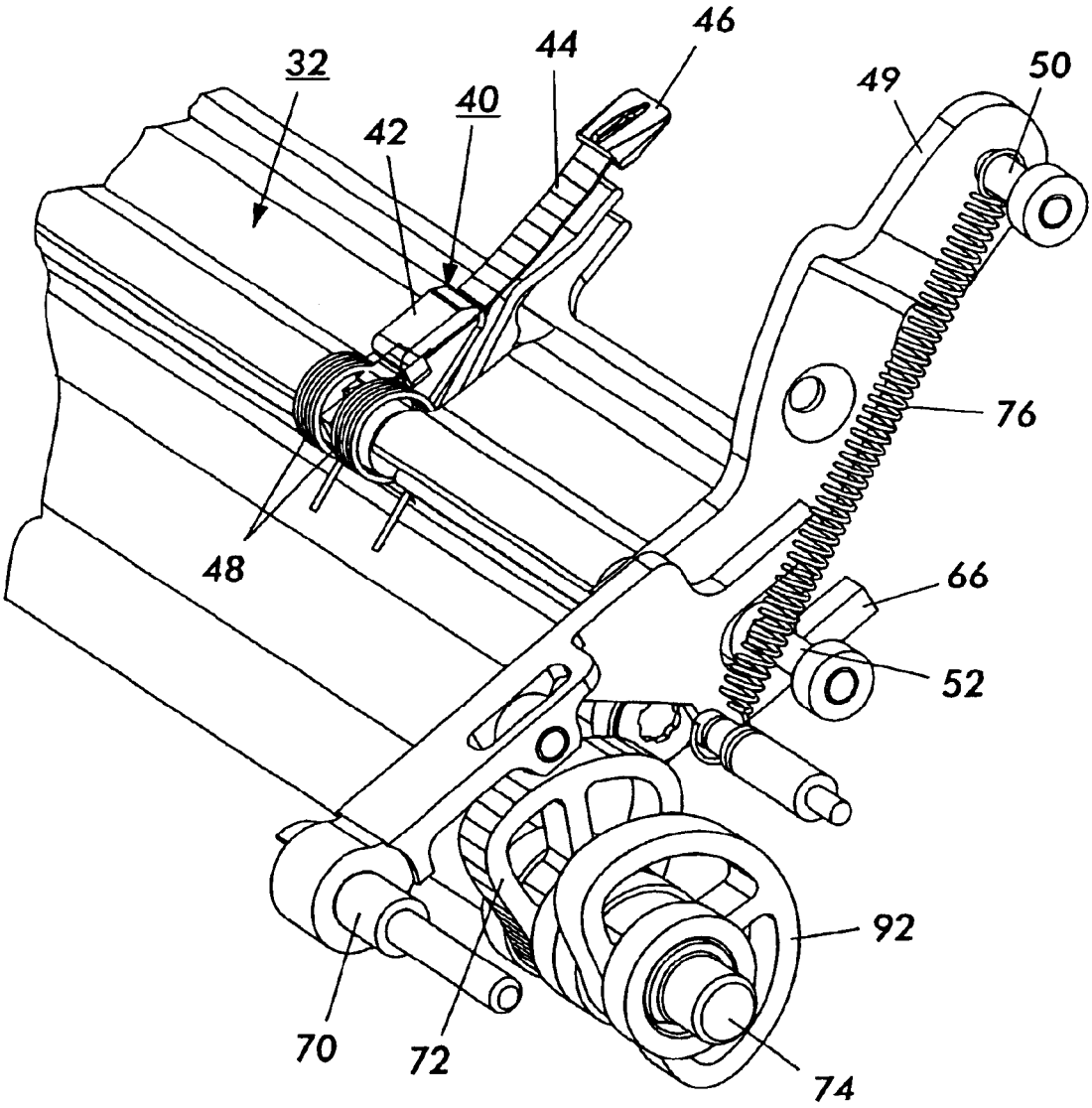
FIG. 13 is a perspective view of a media removal apparatus viewed from the fuser nip exit or downstream side thereof with the baffle structure removed and with the stripper fingers in an active or lead edge stripping orientation.
Figure 14:
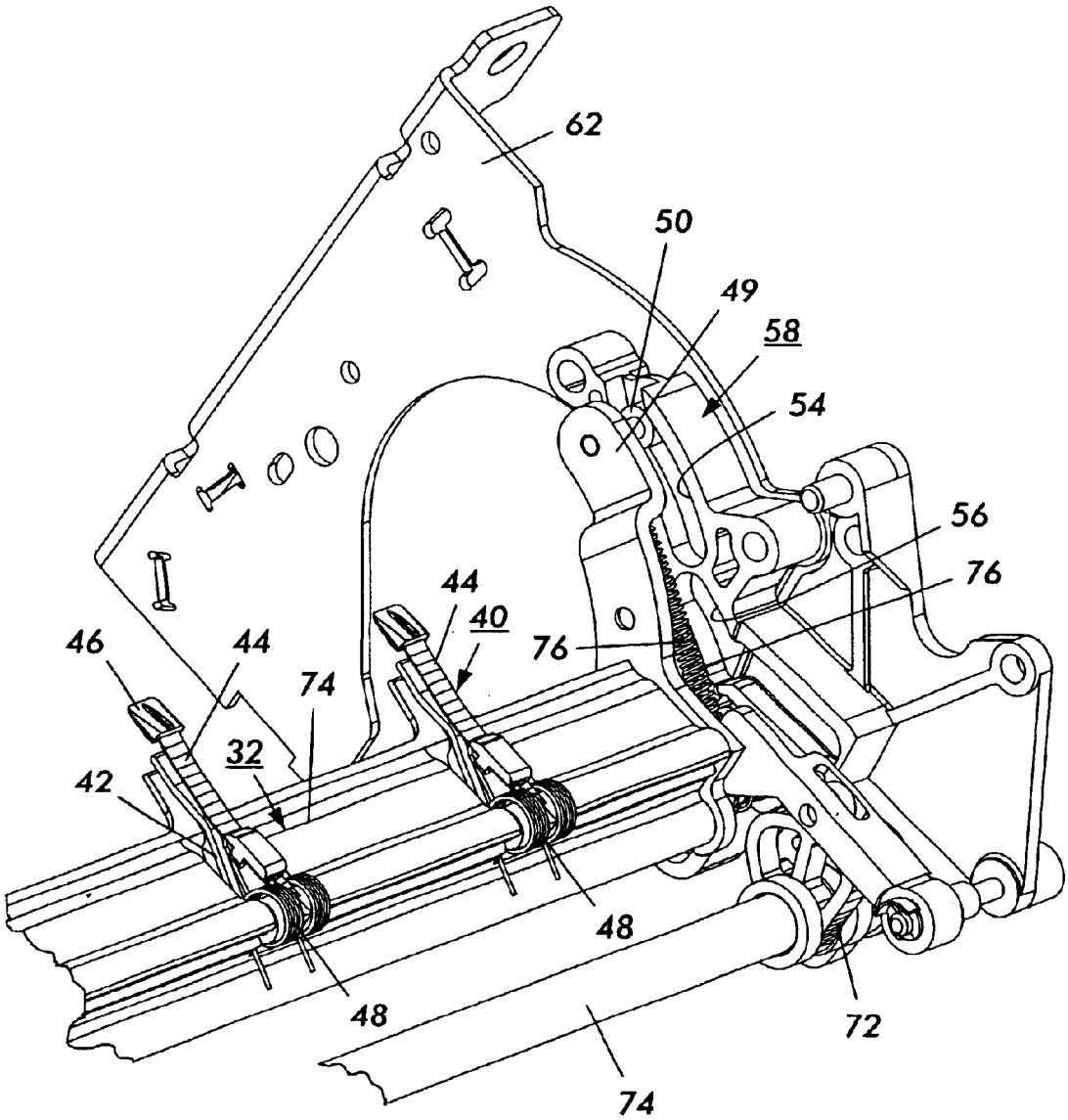
FIG. 14 is another perspective view of a media removal apparatus viewed from the exit or downstream side thereof with the baffle structure removed and with the stripper finger structure in an active or lead edge stripping position.

The stripper finger structure 32 comprises a generally triangular base member 36 (FIG. 2) carrying a shaft 38 that is substantially coextensive with the length of the triangular base member. The shaft 38 pivotally supports a plurality of stripper finger assemblies 40 (FIGS. 13 and 14). Each stripper finger assembly comprises a base member 42 (FIGS. 13 and 14) fabricated from a suitable plastic or metal material. A leaf spring 44 is mounted at one end on the base member 42 and has affixed to its free end a plastic tip 46 that always contacts the heated fuser roll and intermittently contacts imaging media as will be discussed hereinafter.

Torsion springs 48 for each stripper finger assembly are supported by the shaft 38 for biasing the base member 42 of the stripper finger assemblies into engagement with the triangular base member such that the stripper finger tips contact the heated fuser roll member when in a media stripping and standby position. The leaf springs 44 serve to provide suitable biasing of the fingertips 46 into engagement with the surface of the heated fuser roll for effecting lead-edge separation of an imaging media.

A pair of support arms 49 are disposed, one each, at the ends of the generally triangular base member 36. Each support arm carries an upper, sidewardly projecting guide arm 50 and a lower, sidewardly projecting guide arm 52. The free ends of each pair of upper and lower guide arms 50, 52 are received in a pair of upper and lower tracks 54, 56 (FIGS. 2 and 4–12) respectively provided in track structures 58 adjacent each end of the stripper finger structure. The track structures 58 are mounted on fuser frame members 62. The tracks 54, 56 cooperate with the guide arms 50, 52 for insuring proper movement of the stripper finger structure 32 between lead edge media stripping and non-stripping positions.

The lower, sidewardly projecting guide arms 52 (one for each end of the stripper finger structure (FIGS. 4 and 13)) are received, one each, in a pair of bifurcated cam followers 66 (FIGS. 4, 7 and 13) that are pivotally mounted on stationary shafts 70. The bifurcated cam followers 66 serve to impart movement of the stripper finger structure 32 between lead edge stripping and non-stripping positions. To this end, a pair of cams 72 carried by opposite ends of a camshaft 74 engage the bifurcated members 66 for imparting the desired movement of the stripper finger structure between stripping and non-stripping positions. Tension spring members 76 secured to the upper, sidewardly projecting guide arms 50 provide biasing for effecting return of the stripper finger structure to its home or standby position after media lead edge separation has occurred and the cams 72 have been returned to their home position through rotation of the camshaft 74.

Rotation of the camshaft 74 is effected using a stepper motor and associated gearing (not shown). Such mechanisms for imparting motion are well known in the art and a detailed discussion thereof is deemed unnecessary.

The stripping baffle structure 34 (FIGS. 2, 3 and 15) comprises a castellated base member 28 with openings 78 through which the stripper finger assemblies pass during relative movement of the stripper finger and baffle structures. The function of the stripping baffle is to effect separation of the remainder of the imaging media after the lead edge thereof has been separated from the heated fuser roll by the stripper fingers. To this end, the stripper baffle is adapted to be moved from a home or standby position to continue separation of the imaging media once the stripper fingers have separated the lead edge of the imaging media. A pair of arms 80 (FIGS. 9, 10, 12 and 15) attached to the ends of the stripper baffle base serve to movably support the base member for movement between active and inactive positions. One end of each arm is provided with a sidewardly projecting pin member 82 that is received in a first track 84 (FIG. 15) forming a part of the track structures 58. The other end of the baffle arm is pivotally mounted on a shaft 86. The shaft 86 also supports a boomerang shaped linkage 88 adjacent one end thereof. The linkage is supported proximate its center by the stationary shaft 70. The other end of the linkage 88 acts as a cam follower that operatively engages cams 92 carried by the camshaft 74. The cams 92 effect automatic movement of the stripping baffle structure between its home or standby position and an active position proximate the heated fuser roll for separating the portion of the imaging media beyond the lead edge portion separated by the strippers. The cams 92 cause the cam follower ends of the linkage 88 to rotate about the stationary shaft 70 which, in turn, causes the shaft 86 to move the arms 80 attached to the baffle base member 28.

Figure 15:
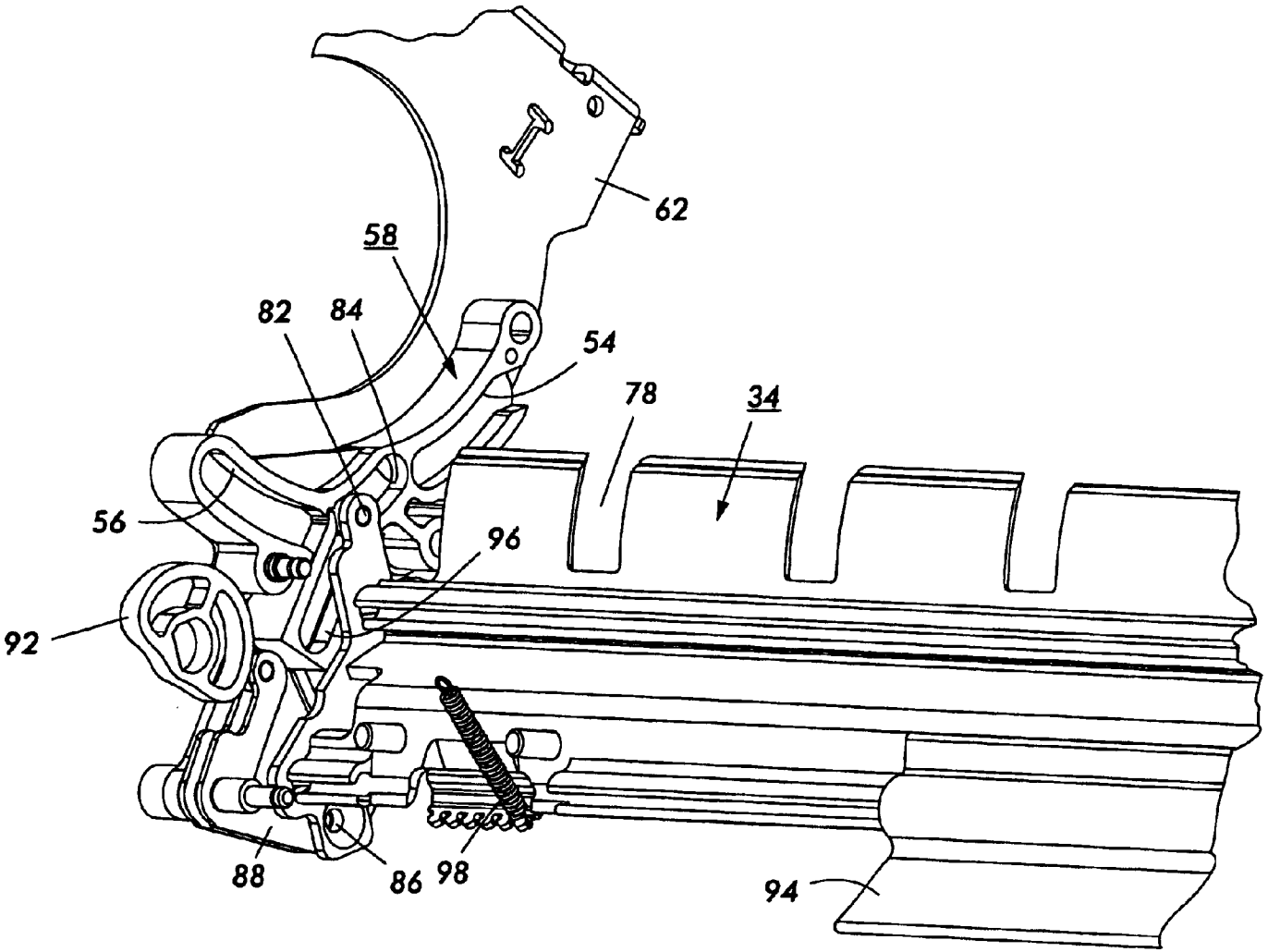
FIG. 15 is a perspective view from the lower and upstream side or entrance to a media removal apparatus with the stripper finger structure removed and with the baffle stripper in a home or standby position.

The stripper baffle may also be manually moved so as to facilitate a jam clearance. To this end, a protruding gripper member 94 (FIG. 15) forms a part of the baffle's base. A second pair of guide tracks 96 which also receive the pin members 82 provide a pathway for the pin members 82 to move, together with the stripping baffle, in a generally downward direction. As shown in FIG. 15, the stripper baffle is in its standby position where the pin members are at the transition between the first and second sets of tracks 84, 96. In the jam clearance position (FIGS. 8–10) the pin members 82 ride to the bottom of the tracks 96 to a lowered position of the stripping baffle structure that allows for access to a jammed imaging media. Extension springs 98 secured to end of the stripper baffle structure serves to bias it into its home or standby position.

The table below lists which figures illustrate the active, standby and jam clearance positions for the stripper finger and the stripper baffle structures for each of FIGS. 2–15. A comparison of the active positions of the stripper fingers with the active positions of the stripper baffle show the relative positions of the two structures for each of the Figures in those figures that show both structures.

TABLE

Figure 2:
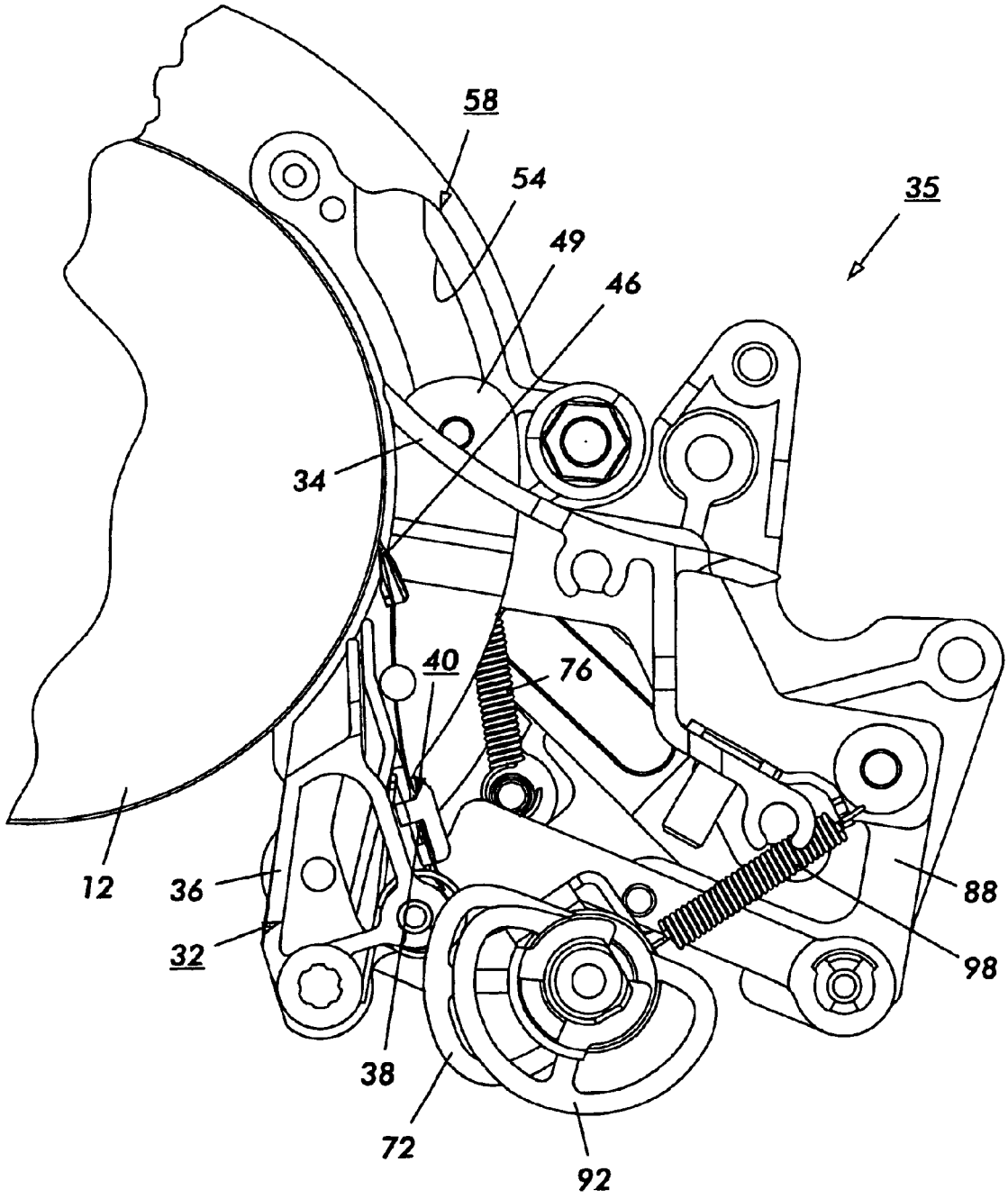
FIG. 2 is a side elevation view of a heated fuser roll and a media removal apparatus illustrating a stripper finger home or standby position and a stripping baffle in its active or media stripping position.
Figure 3:
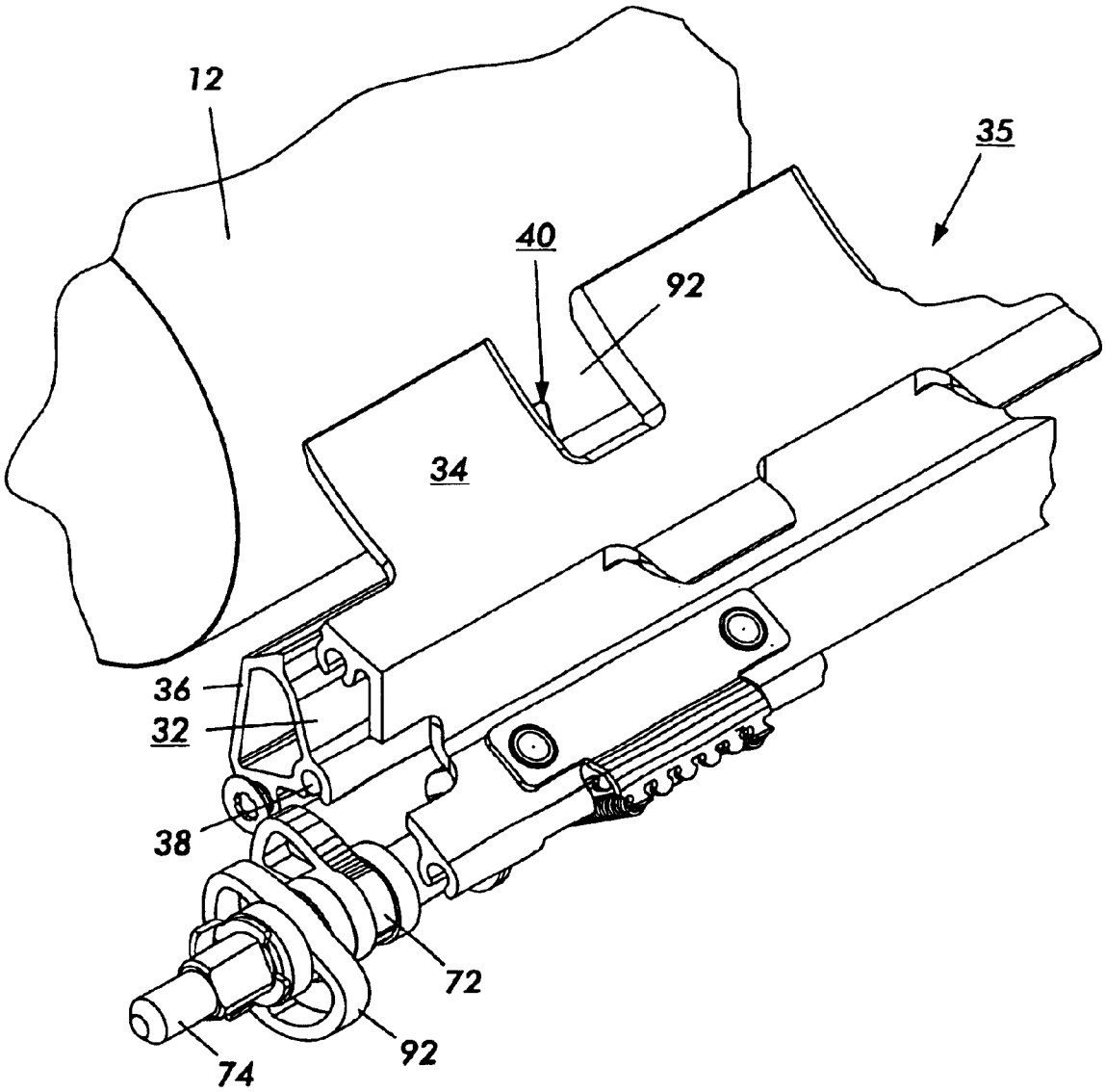
FIG. 3 is a perspective view of a media removal apparatus viewed from the fuser nip exit or downstream side of the fuser showing the stripper fingers in the home or standby position and the stripping baffle structure in the active position.
Figure 4:
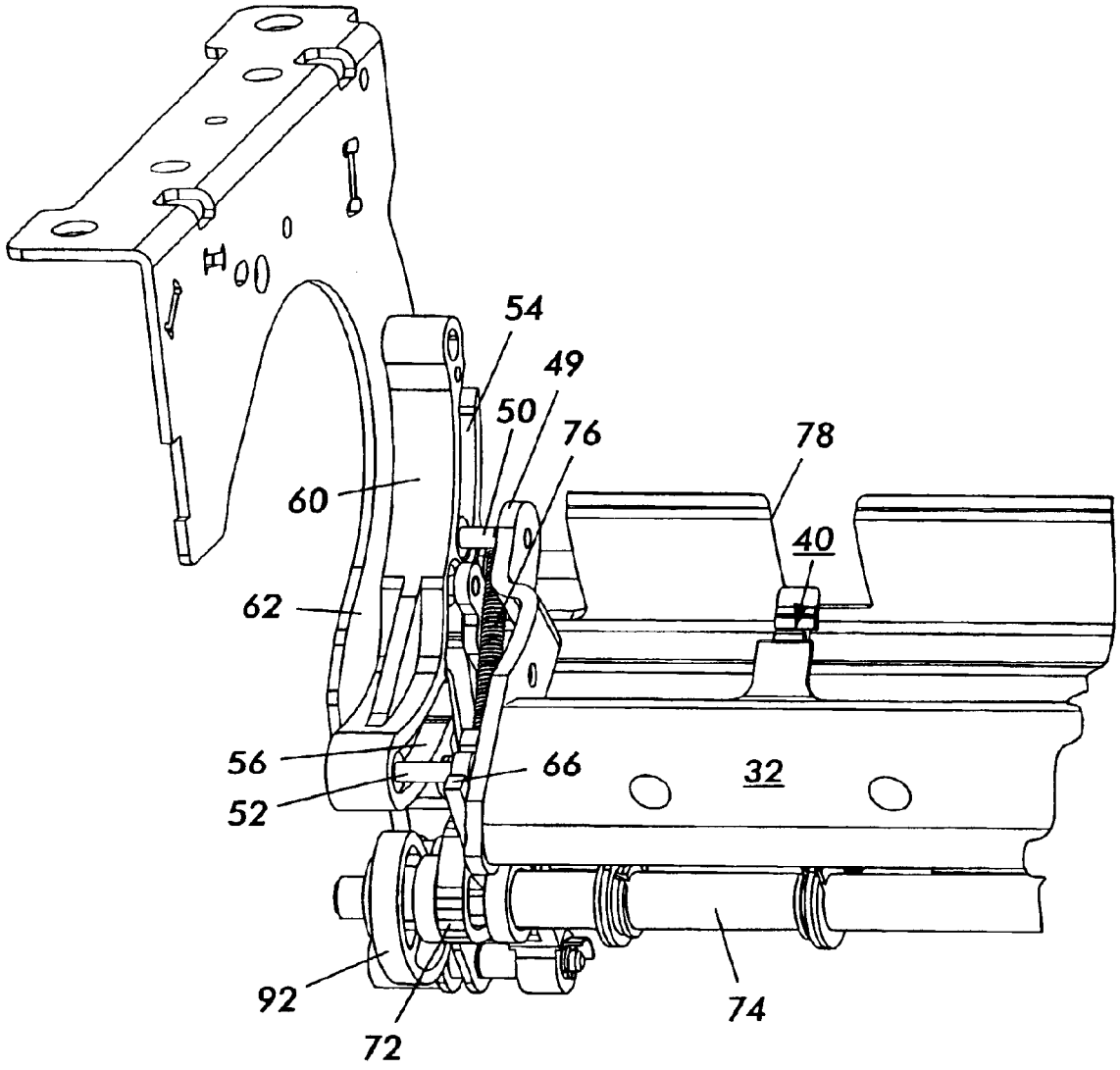
FIG. 4 is another perspective view of a media removal apparatus viewed from the upstream or fuser nip entrance side of the fuser in the same positions as in FIGS. 2 and 3.
Figure 5:
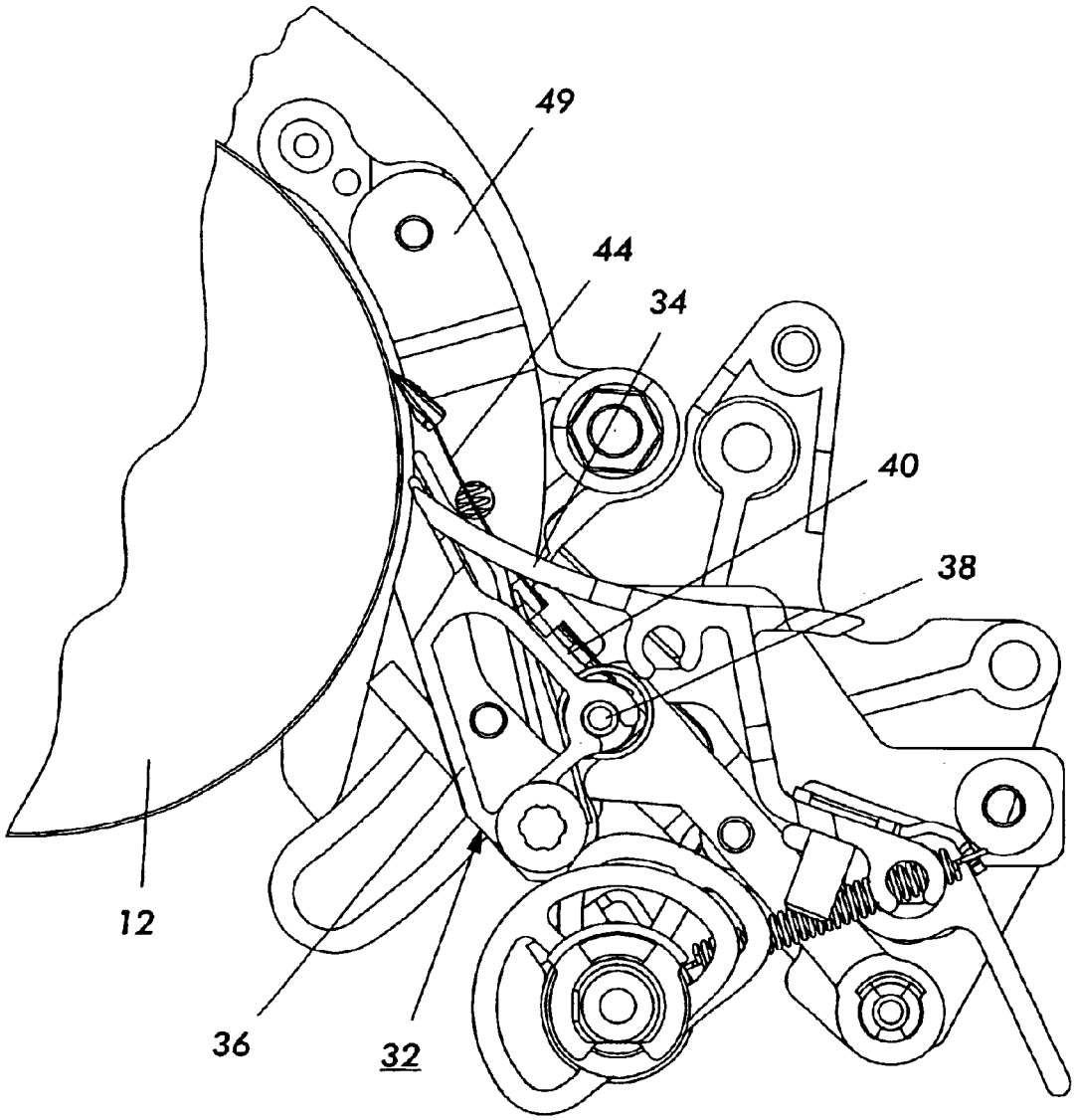
FIG. 5 is a side elevation view of a media removal apparatus illustrating the stripper fingers in their active or lead edge stripping position and the stripping baffle in its home or standby position.
Figure 6:
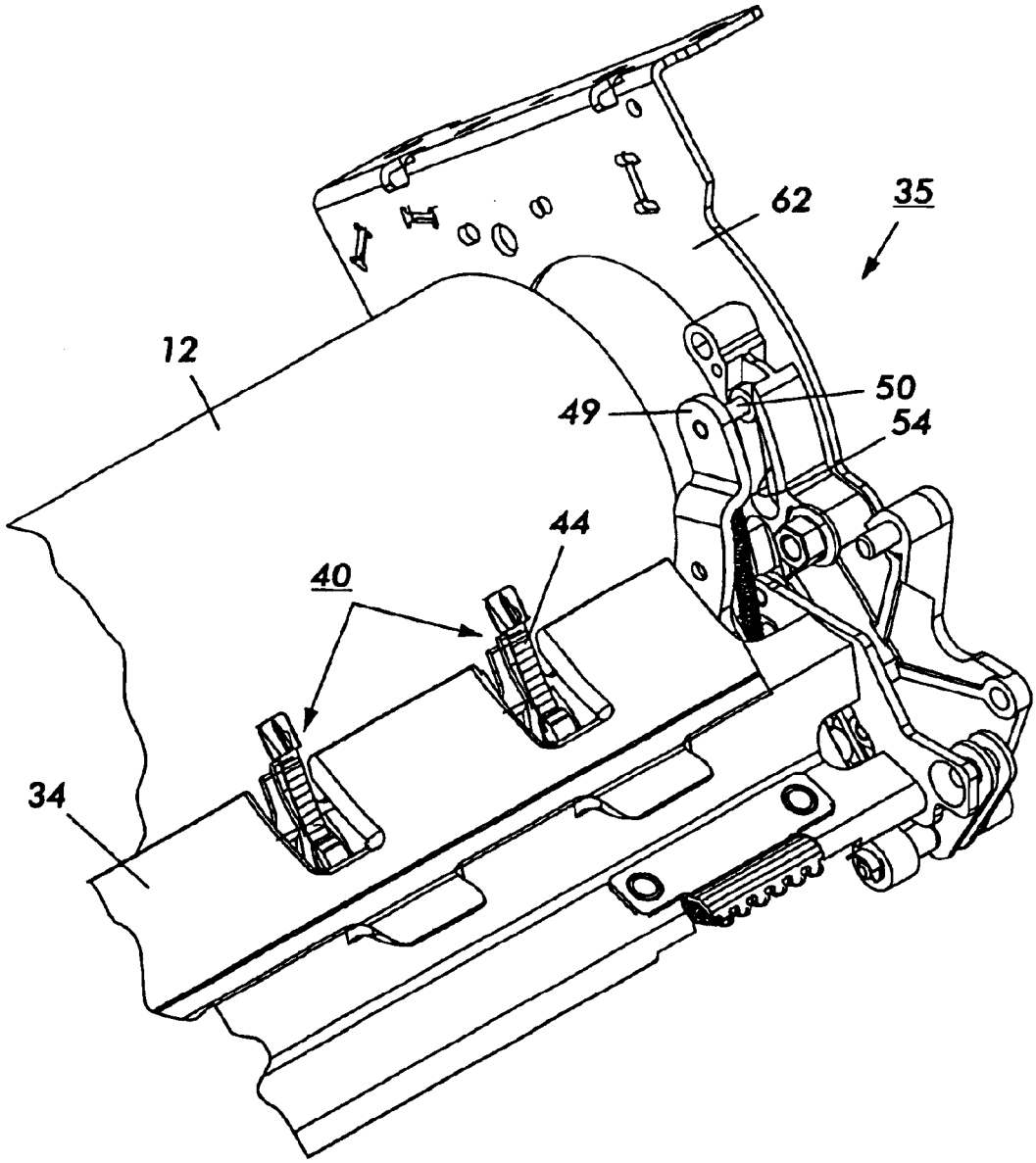
FIG. 6 is a perspective view of a media removal apparatus viewed from the downstream or nip exit side of the fuser illustrating the stripper fingers in their active or lead edge stripping position and the stripping baffle in its home or standby position.
Figure 7:
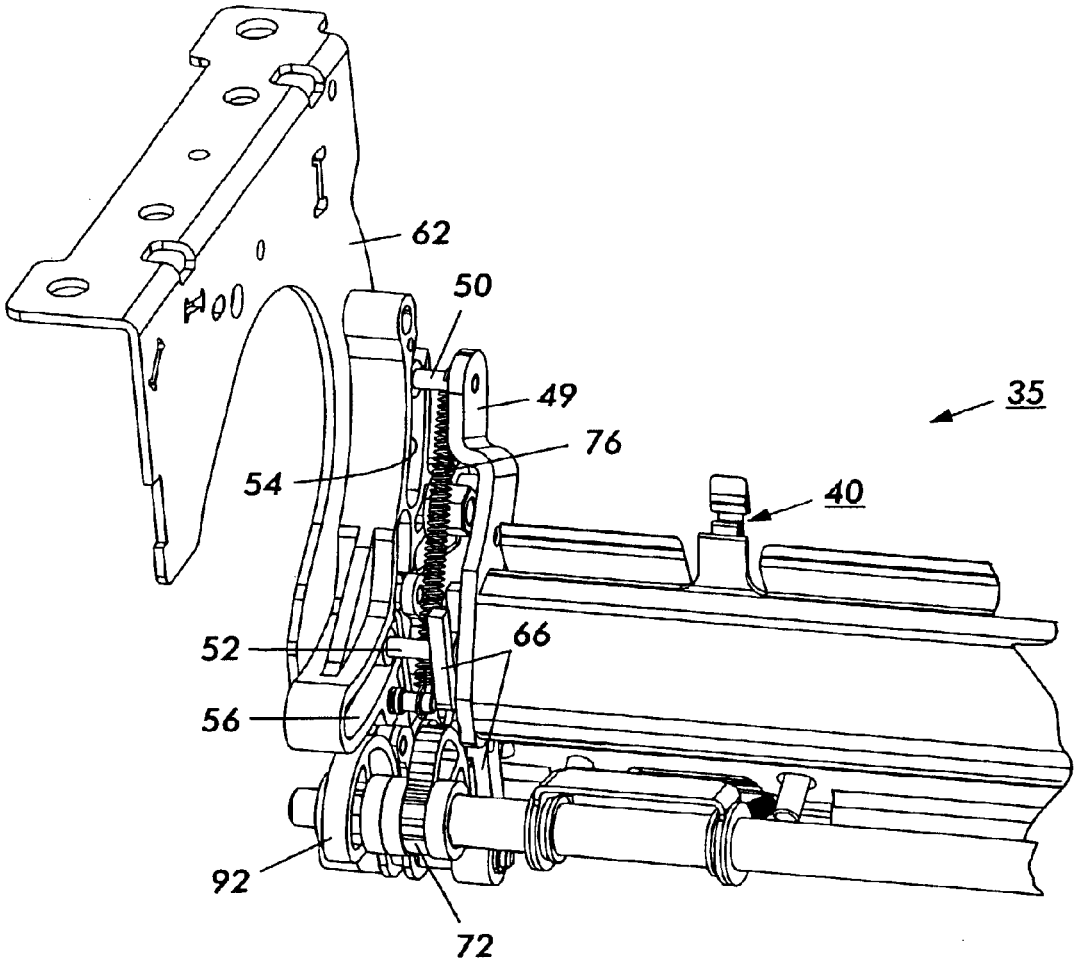
FIG. 7 is another perspective view of a media removal apparatus viewed from the upstream of nip entrance side of the fuser illustrating the stripper fingers in their active or media stripping position and the stripping baffle in its home or standby position.
Figure 8:
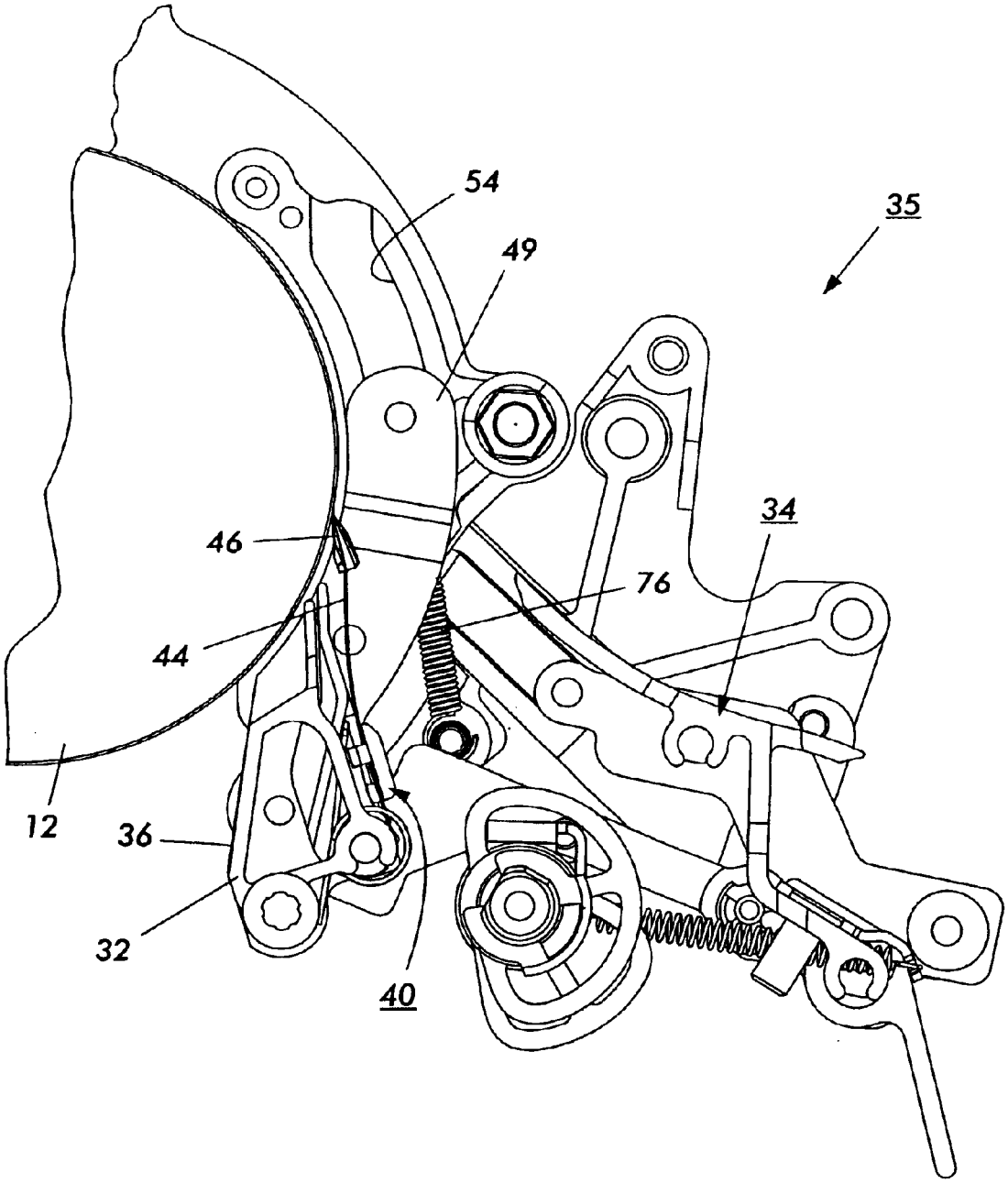
FIG. 8 is a side elevation view of a media removal apparatus showing the stripper baffle in its jam clearance position and the stripper fingers in their standby position.
Figure 9:
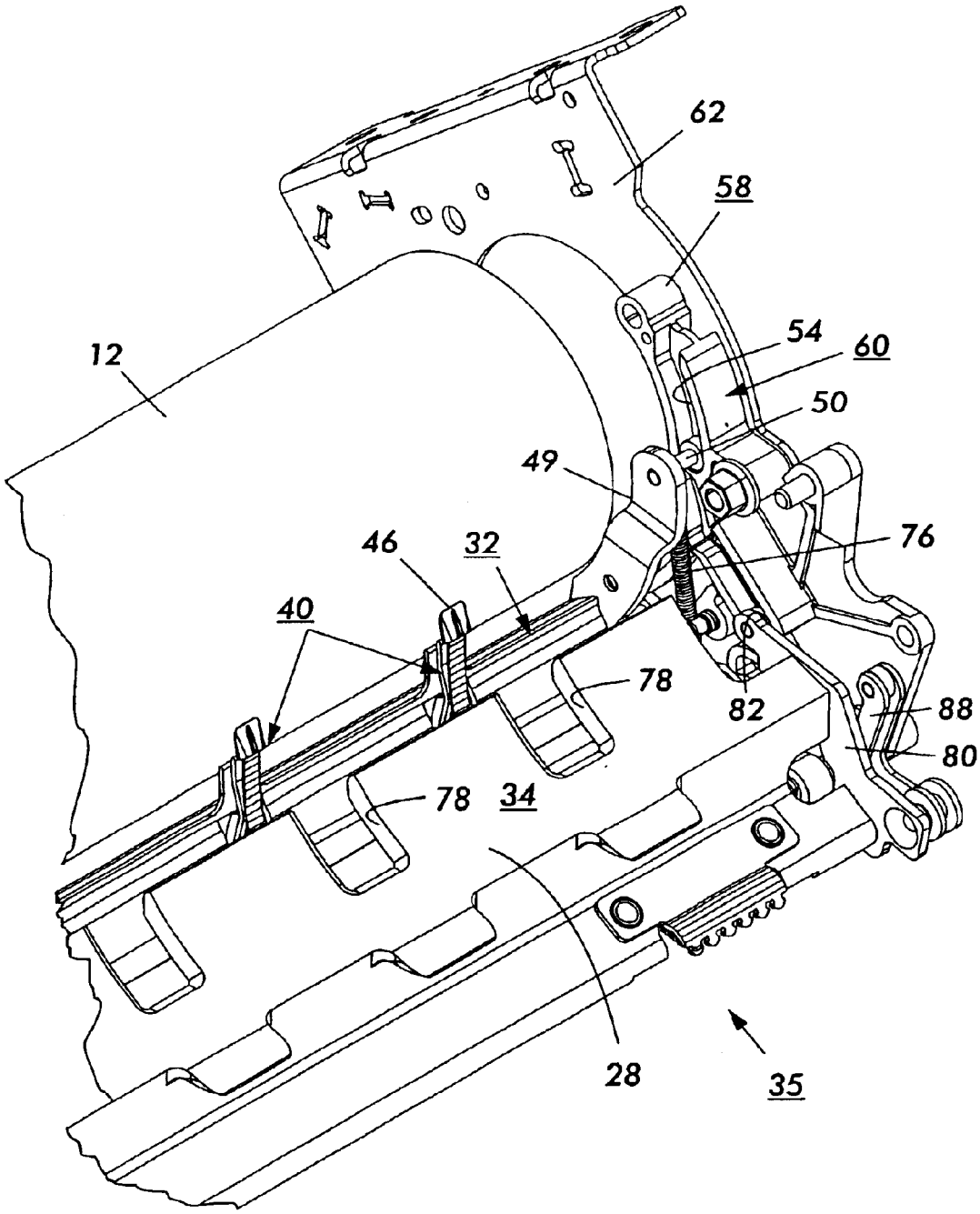
FIG. 9 is a perspective view of a media removal apparatus showing the stripper baffle in a jam clearance position as viewed from the downstream or exit side of the fuser and the stripper fingers in their standby position.
Figure 10:
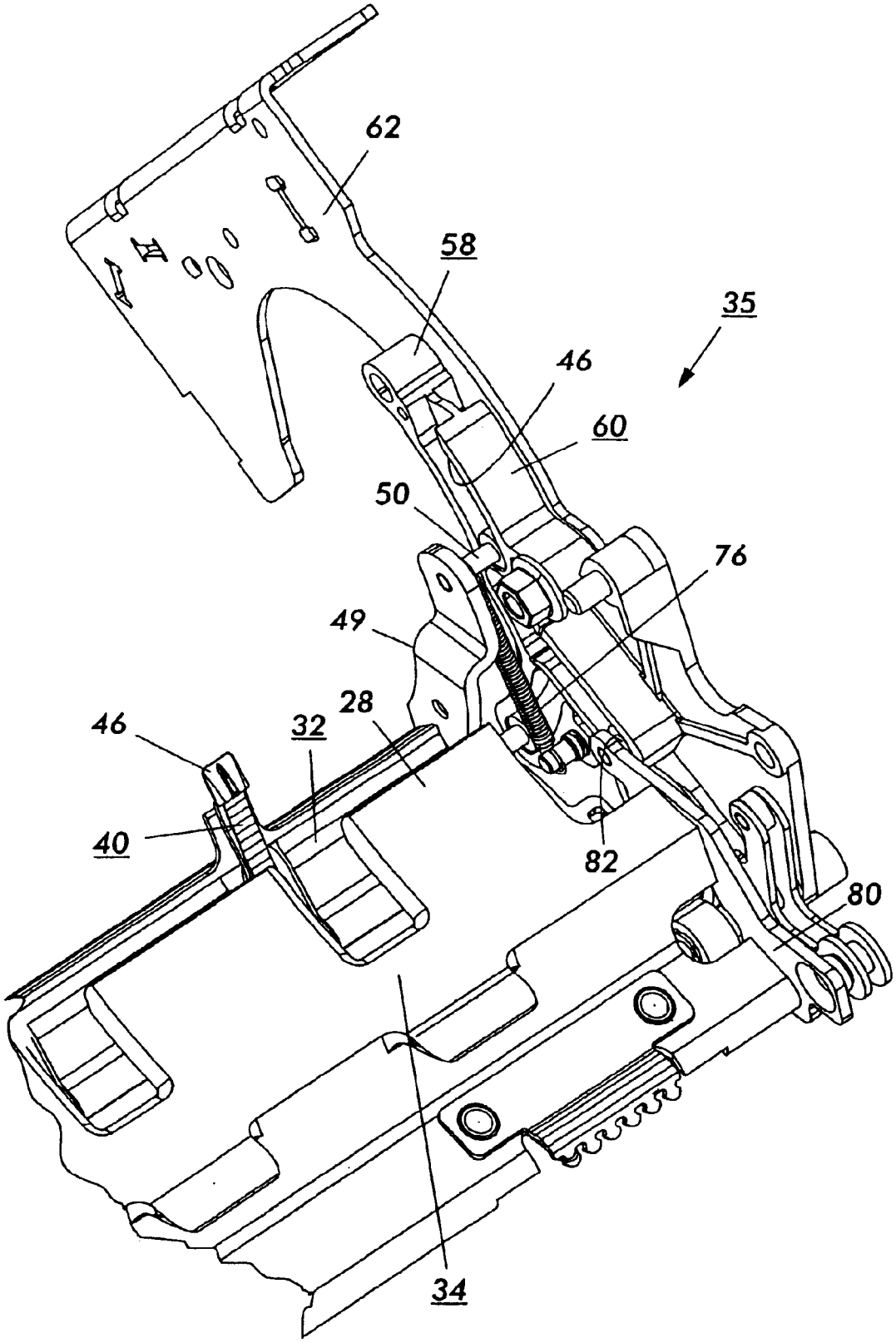
FIG. 10 is another perspective view a media removal apparatus with the stripper baffle shown in a jam clearance position as viewed from the downstream or exit side of the fuser and the stripper fingers in their standby position.
Figure 11:
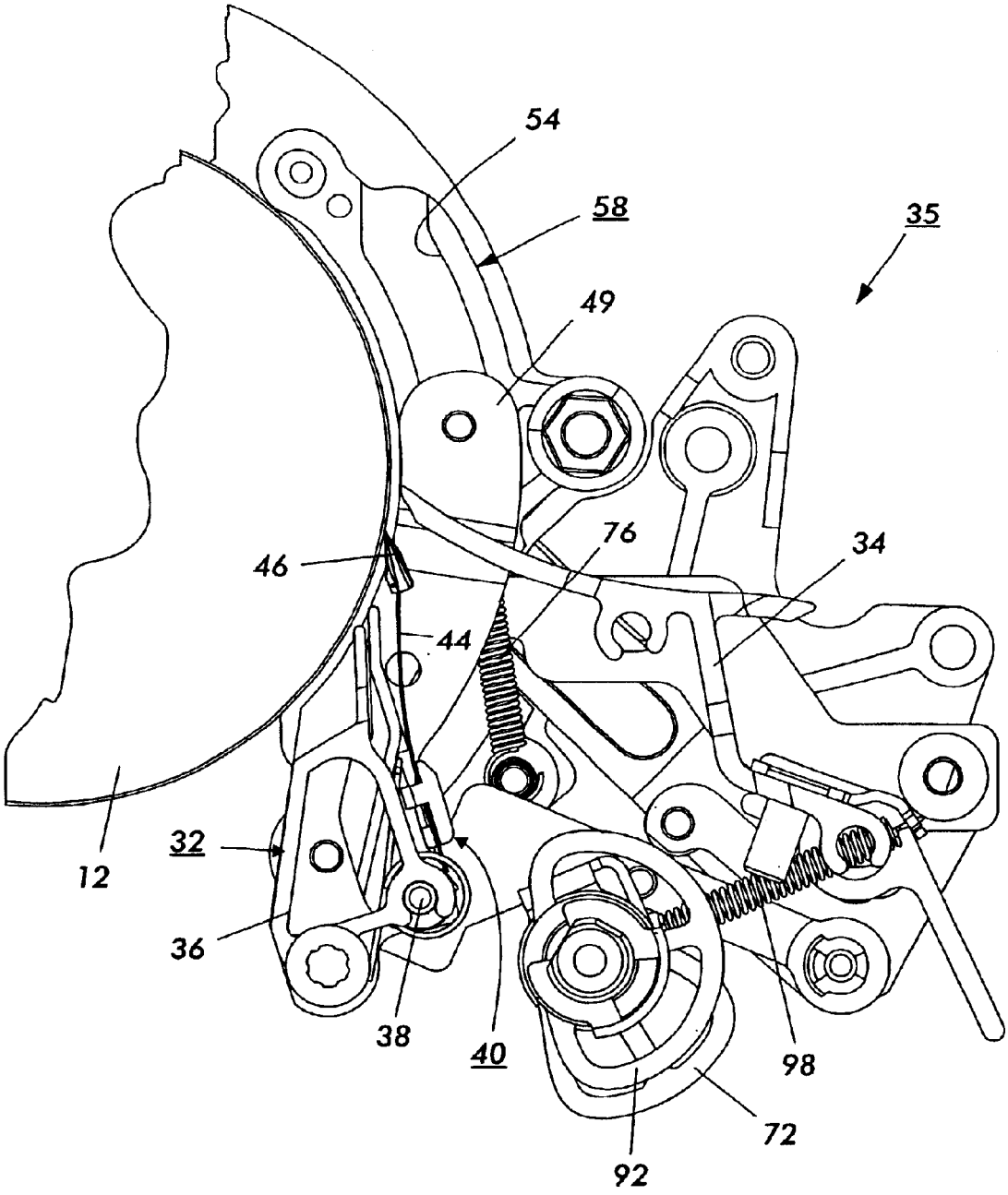
FIG. 11 is a side elevation view of a media removal apparatus showing the stripper fingers and stripping baffle in the home or standby position.
Figure 12:
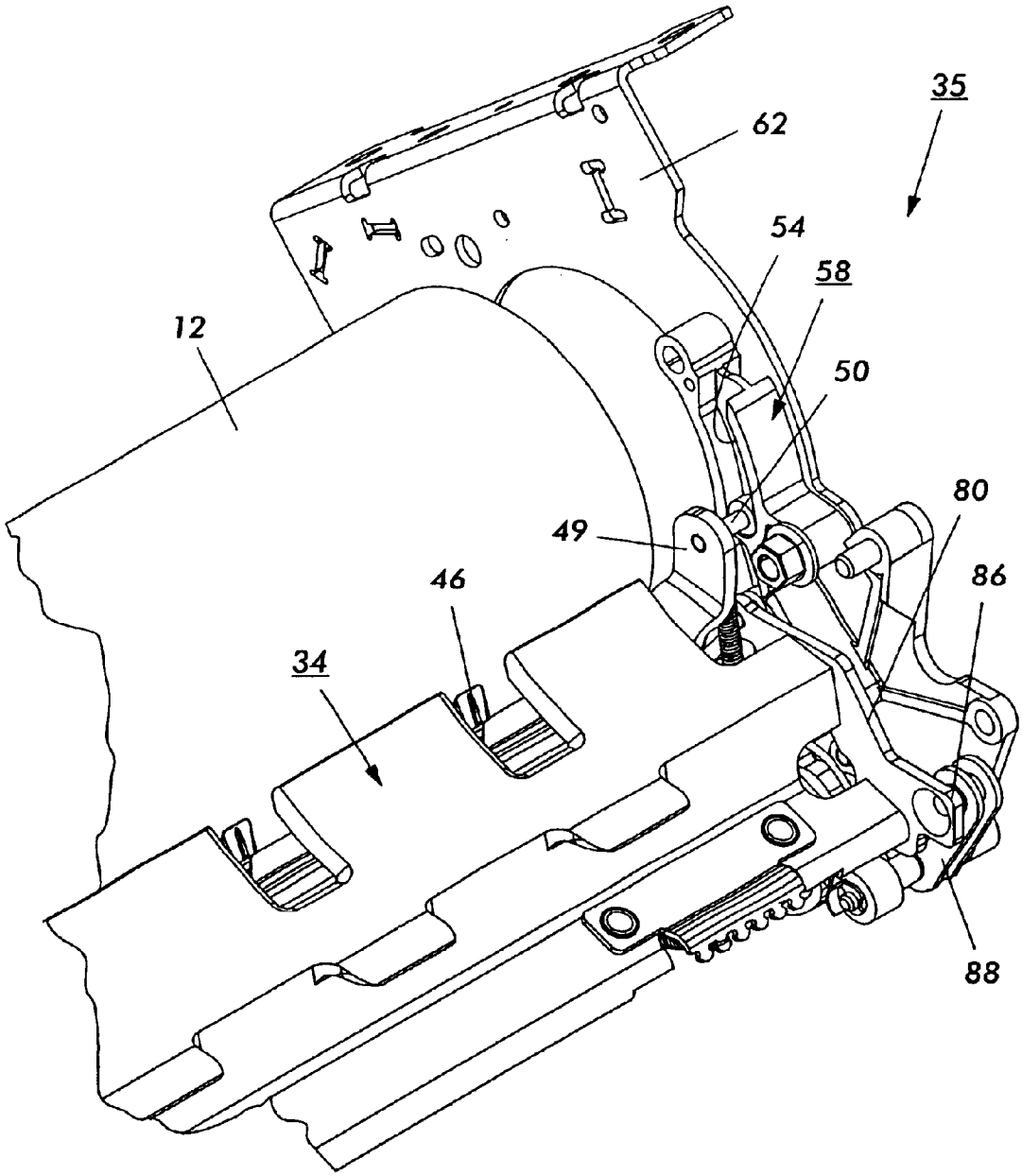
FIG. 12 is a perspective view of a media removal apparatus viewed from the downstream or nip exit of the fuser illustrating the stripper fingers and stripping baffle in the home or standby position.

| Stripper Fingers | | Stripper Baffle | | |
|---|---|---|---|---|
| Active | Standby | Active | Standby | Jam Clearance |
| FIGS. 5–7, 13–14 (No Baffle) | FIGS. 2–4, 8–12 | FIGS. 2–4 | FIGS. 5–7, 11–12, 15 (No Stripper Fingers) | FIGS. 8–10 |

In operation, the stripper finger and stripper baffle structures of the media removal apparatus cooperate to separate the imaging media from a heated fuser roll. These two structures are initially in their standby position prior to the imaging media arriving at the nip exit of the fuser roll. As the imaging media approaches the nip exit, the stripper finger assemblies and the stripper finger baffle are moved toward the imaging media path such that the finger tips protrude above the surface of the stripper baffle. The fingers remain above the stripper baffle just long enough to separate the lead edge of the imaging media from the fuser roll. Thus, the stripper fingers remain active or in contact with the imaging media for the first 3–15 mm of length of the imaging.

The shape of the tracks 54, 56 and 84 keep the fingers 46 and the baffle 28 in a constant radial position relative to the fuser roll 12 while allowing rotation around the center of the fuser roll 12. This rotation effects movement of the fingers or baffle into the media-imaging path. The tracks allow the heated fuser roll and the stripper finger structure to be removed from the fuser apparatus. Track 96 supports the stripper baffle guide roller 82 when the fuser roll parts (track structure 58 and stripper finger structure 32) are removed from the fuser for service. Track 96 lines up with track 84 when the fuser is reassembled such that no operator intervention is required to guide the parts back together. Track 96 also is used to guide the baffle during the manual positioning into jam clearance position.

The stripper finger and stripper baffle structures occupy four different relative positions, three of which were just described above. That is, the stripper finger and baffle structures simultaneously occupy a standby position and when the stripper finger structure is active the stripper baffle structure is in the standby position. Contrariwise, when the stripper finger structure is in the standby position the stripper baffle structure is active. In the first relative position (i.e. both stripper structures in the standby position) there is obviously no imaged media separation. In a second relative position, the stripper finger structure is in its active position with the stripper fingers above the baffle for effecting separation of the lead edge of the imaging media. In the third relative position, separation of the imaging media beyond its lead edge is under the control of the stripper baffle structure while in its active position.

In the fourth relative position the stripper baffle structure has manually or otherwise been moved from its active position in a direction away from the heated fuser roll where it initially occupies its standby position. The stripper baffle is also moved in a downward direction in order to facilitate access for jam clearance.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. Heat and pressure roll fuser apparatus, said apparatus comprising:

a heated fuser roll;

a pressure roll adapted for pressure engagement with said heated fuser roll to form a nip through which imaging media pass with toner images carried thereby contact said heated fuser roll;

an imaging media removal apparatus including:

a stripper finger structure with stripper fingers supported for movement between a standby position and an active position for separating a leading edge of said imaging media from said heated fuser roll;

a stripper baffle structure supported for movement between a standby position and a media stripping position for separating said imaging media beyond said leading edge;

means for intermittently moving said stripper finger structure and said stripper baffle structure between said standby and said active positions whereby said stripper fingers contact said heated fuser roll in an imaging media stripping position followed by positioning of said baffle structure in close proximity to said heated fuser roll for effecting removal of said imaging media beyond said leading edge.

2. The apparatus according to claim 1 wherein said means for intermittently moving said stripper finger structure and said stripping baffle structure comprises a camshaft carrying pairs of cams, one pair for effecting movement of said stripper finger structure and the other for effecting movement of said stripping baffle structure.

3. The apparatus according to claim 2 including a plurality of tracks cooperating with means forming a part of said stripper finger structure and said stripper baffle structure for effecting movement thereof in predetermined paths.

4. The apparatus according to claim 1 including means for permitting manual movement of said stripping baffle structure to a jam clearance position and means for manually effecting movement of said stripping baffle structure to said jam clearance position.

5. The apparatus according to claim 4 wherein said plurality of tracks comprises first pairs of tracks for guiding said stripper finger structure for movement between standby and active positions and second pairs of tracks for guiding said stripper baffle structure to said jam clearance position.

6. The apparatus according to claim 1 wherein said stripper finger and stripper baffle structures are movable to four different relative positions.

7. The apparatus according to claim 6 where in one of four different positions said stripper finger and stripper baffle structures are in a standby position.

8. The apparatus according to claim 7 where in another of said four positions said stripper finger structure is in its active position and said stripper baffle structure is in its standby position.

9. The apparatus according to claim 8 where in still another position said stripper finger structure is in its standby position and said stripper baffle structure is in its active position.

10. The apparatus according to claim 9 where in a fourth relative position said stripper finger structure is in its active position and said stripper baffle structure is in a jam clearance position.

11. An imaging media removal apparatus for use in a heat and pressure roll fuser with a heated fuser roll, said apparatus comprising:

a stripper finger structure supported for movement between a standby position and an active position for separating a leading edge of said imaging media from said heated fuser roll;

a stripper baffle structure supported for movement between a standby position and an active position for separating said imaging media beyond said leading edge;

means for intermittently moving said stripper finger structure and said stripper baffle structure between said standby and said active positions whereby said stripper fingers contact said heated fuser roll in an imaging media stripping position followed by positioning of said baffle structure in close proximity to said heated fuser roll for effecting removal of said imaging media beyond said leading edge.

12. The apparatus according to claim 11 wherein said means for intermittently moving said stripper finger structure and said stripping baffle structure comprises a camshaft carrying pairs of cams, one pair for effecting movement of said stripper finger structure and the other for effecting movement of said stripping baffle structure.

13. The apparatus according to claim 12 including a plurality of tracks cooperating with means forming a part of said stripper finger structure and said stripper baffle structure for effecting movement thereof in predetermined paths.

14. The apparatus according to claim 11 including means for permitting manual movement of said stripping baffle structure to a jam clearance position and means for manually effecting movement of said stripping baffle structure to said jam clearance position.

15. The apparatus according to claim 14 wherein said plurality of tracks comprises first pairs of tracks for guiding said stripper finger structure for movement between standby and active positions and a second pairs of tracks for guiding said stripper baffle structure to said jam clearance position.

16. The apparatus according to claim 11 wherein said stripper finger and stripper baffle structures are movable to four different relative positions.

17. The apparatus according to claim 16 wherein one of four different positions said stripper finger and stripper baffle structures are in a standby position.

18. The apparatus according to claim 17 where in another of said four positions said stripper finger structure is in its active position and said stripper baffle structure is in its standby position.

19. The apparatus according to claim 18 where in still another position said stripper finger structure is in its standby position and said stripper baffle structure is in its active position.

20. The apparatus according to claim 19 where in a fourth relative position said stripper finger structure is active position and said stripper baffle structure is in a jam clearance position.

* * * * *